US005537007A

United States Patent [19]

Harberts et al.

[11] Patent Number: 5,537,007

[45] Date of Patent: Jul. 16, 1996

[54] FIELD EMITTER DISPLAY DEVICE WITH TWO-POLE CIRCUITS

[75] Inventors: Dirk W. Harberts; Karel E. Kuijk; Remko Horne; Gerardus N. A. Van Veen, all of Eindhoven, Netherlands; Hans-Helmut Bechtel, Rötgen, Germany

[73] Assignee: U.S. Philips Corporation, New York, N.Y.

[21] Appl. No.: 123,272

[22] Filed: Sep. 17, 1993

[30] Foreign Application Priority Data

Sep. 25, 1992 [EP] European Pat. Off. ..... 92202948

[51] Int. Cl.[6] ..... G09G 3/10

[52] U.S. Cl. ..... 315/169.1; 315/169.2; 315/340; 315/181

[58] Field of Search ..... 315/169.1, 169.2, 315/169.3, 340, 345, 58, 181

[56] References Cited

U.S. PATENT DOCUMENTS

| | | | |
|---|---|---|---|
| 3,522,473 | 8/1970 | Babb | 315/168 |
| 5,075,591 | 12/1991 | Holmberg | 313/495 |
| 5,153,483 | 10/1992 | Kishino et al. | 315/3 |
| 5,162,704 | 11/1992 | Kobori et al. | 315/169.1 |
| 5,177,405 | 1/1993 | Kusuda et al. | 315/169.1 |
| 5,300,862 | 4/1994 | Parker et al. | 315/169.1 |

FOREIGN PATENT DOCUMENTS

| | | |
|---|---|---|
| 0492585 | 7/1992 | European Pat. Off. . |
| 4249026 | 9/1992 | Japan . |

*Primary Examiner*—Vincent P. McGraw
*Assistant Examiner*—Reginald A. Ratliff
*Attorney, Agent, or Firm*—John C. Fox

[57] ABSTRACT

By incorporating two-pole circuits (13) as switching elements in a picture display device based on field emission, the emission (and hence the picture intensity) is substantially defined by the charge of a capacitance (15) associated with a part of a pixel (8). Charge-controlled drive leads to a more accurate adjustment than the voltage-controlled drive used until now and leads to lower drive voltages, less power consumption and a longer lifetime of the phosphors used in the display device.

17 Claims, 4 Drawing Sheets

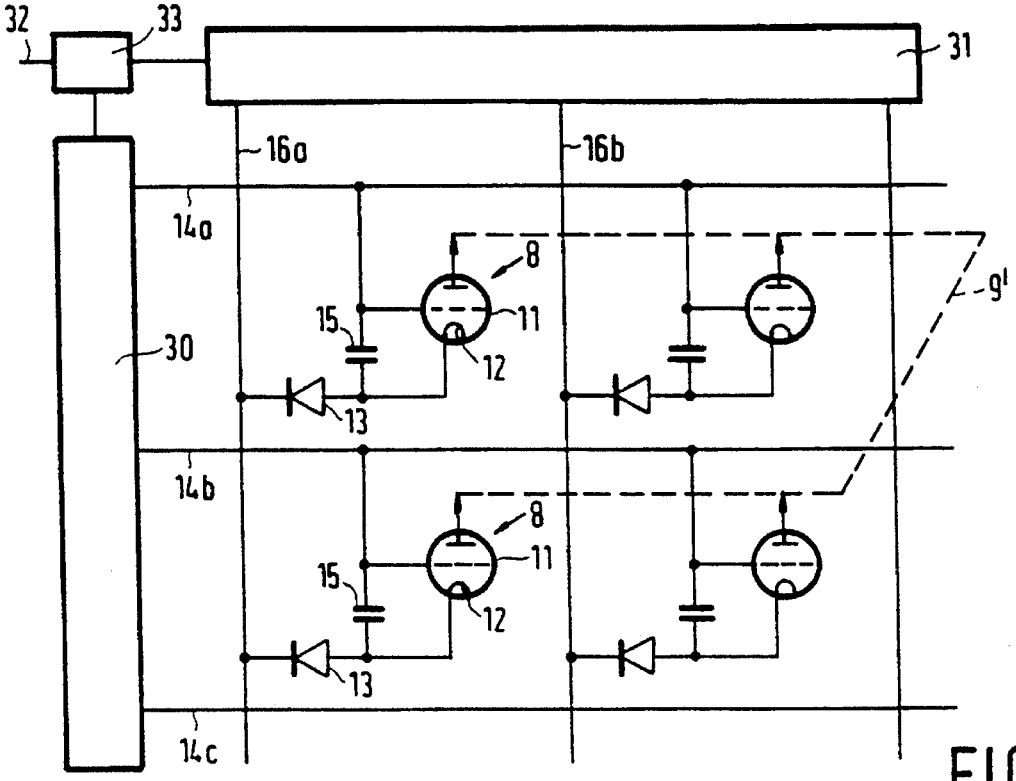
FIG. 3
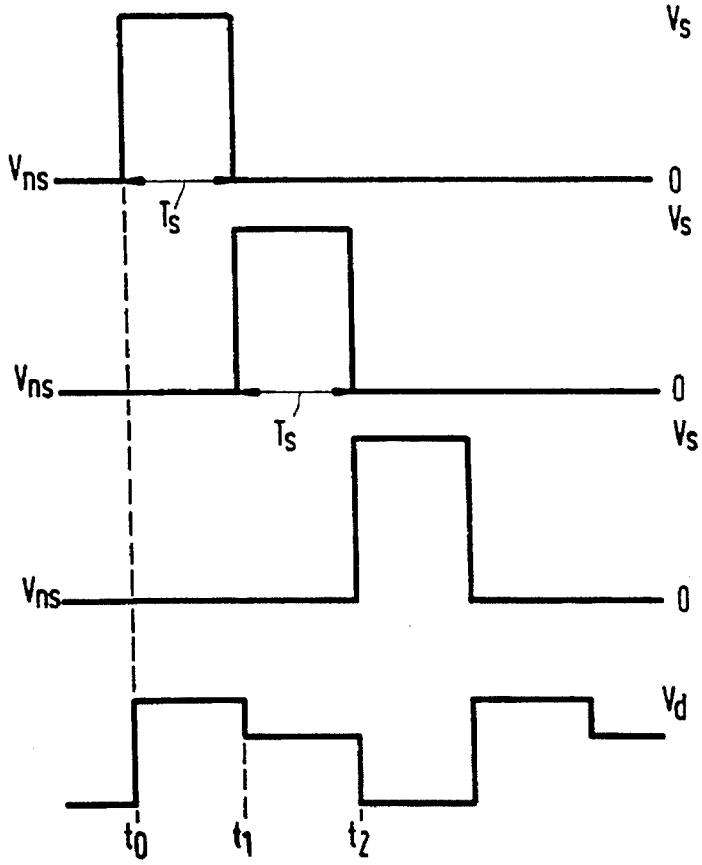
FIG. 4a
FIG. 4b
FIG. 4c
FIG. 4d

FIELD EMITTER DISPLAY DEVICE WITH TWO-POLE CIRCUITS

BACKGROUND OF THE INVENTION

This invention relates to a display device comprising a plurality of pixels arranged in rows and columns at the location of crossings of row electrodes and column electrodes, each pixel comprising at least one field emitter connected to a cathode terminal in an electrically conducting manner and a grid electrode.

A display device of this type is usually in the form of a flat display device and is suitable, for example, for displaying video information and alpha-numerical information. A display device of this type is described in U.S. Pat. No. 5,075,591. The device shown in this document comprises strip-shaped row electrodes and column electrodes on a substrate and a matrix of pixels, each defined by a plurality of tip-shaped (pointed) field emitters on the row electrodes at the location of crossings with column electrodes. The column electrodes, which also function as grid electrodes in this case, are separated from the row electrodes by means of a layer of insulating material. At the location of the pixels, apertures are present in the column electrodes and the subjacent insulating material. Electrons released by field emission can thus be accelerated to phosphors on a faceplate located opposite the substrate.

The display device is driven by selecting a row electrode during a row selection period (which is for example 32 μsec), for example, by presenting a sufficiently low voltage. Simultaneously, data voltages are presented to the column electrodes. The potential difference between the field emitters connected to the row electrodes and the grid (column) electrodes determines the emission of the associated field emitters and hence the light intensity of a pixel.

To obtain a light intensity which is as uniform as possible across the entire surface in such a display device, it is important that the field emitters behave as uniformly as possible, for example, with regard to their current-voltage characteristic. This requires a substantially identical shape of all tip-shaped (pointed) field emitters, which imposes very strict requirements from a technological point of view. Since this requirement cannot generally be satisfied in practice, an extra resistor is often arranged in series with the pixel, for example, between the field emitters and the row electrode for the purpose of uniformity. However, this leads to a higher power consumption and higher drive voltages. For these higher drive voltages it may be necessary to have drive electronics with special circuits, which may additionally increase the cost of these drive electronics, for example, because low-cost technologies such as, CMOS are no longer useable.

Moreover, it is necessary for a satisfactory operation that the column electrodes are not too far remote from the field emitters, hence from the row electrodes. However, this increases the capacitance associated with such a field emitter and hence the RC time for a presented addressing signal; as a result, the value of the signal, viewed across the length of a selection electrode, may decrease, which also gives rise to a non-uniform emission behaviour.

OBJECTS AND SUMMARY OF THE INVENTION

It is, inter alia, an object of the invention to provide a display device of the type mentioned in the opening paragraph in which said problems are solved as much as possible. It is based on the recognition that controlled field emission is possible by charge-controlled rather than voltage-controlled driving.

To this end a display device according to the invention is characterized in that each pixel comprises an asymmetric two-pole circuit between a column electrode and the field emitter.

In this respect an asymmetric two-pole circuit is understood to mean a two-terminal device having an asymmetrical current-voltage characteristic, such as that of inter alia, a pn-diode, a Schottky diode, or a pin diode. The circuit may also comprise one or more of these diodes which, due to redundancy or for other reasons, are arranged in series and/or parallel. Instead of a diode, the use of transistors arranged as diodes is alternatively possible.

In the device according to the invention, the two-pole circuit is opened during selection (during the row selection period), so that a capacitance associated with the field emitter is charged to a value determined, inter alia by the voltage across the column electrode (data voltage). After the switch has closed, the capacitance is discharged within the rest of a frame period (for example 20 msec) via the field emitter due to electron emission. The light intensity of a pixel is now determined by the quantity of charge across the capacitance. This capacitance, which in the voltage-controlled drive mode results in a delay of the signal and is thus minimized as much as possible by very strict tolerances in the manufacturing process may now have a value which occurs in the conventional method of manufacture (due to, inter alia, the conventional wide process tolerances). This value is usually such (or may be adapted in such a way) that the capacitance associated with the field emitter is discharged within a frame period.

Since the stored charge is decisive of the luminance of a pixel, the display device is substantially insensitive to fluctuations in the current-voltage characteristics of the separate field emitters. Since the (electron) current can flow in the field emitters for a longer period of time, lower drive voltages are sufficient, dependent on the capacitance and the quantity of charge. This not only leads to a reduced power consumption, but also reduces the risk of damage due to excessive current passage so that a resistance layer under the field emitters can be dispensed with.

Problems of phosphor saturation are also reduced by using lower drive voltage (and consequently lower currents). Due to saturation effects in the phosphors on the face plate, which phosphors must be driven within a short period of time, it is often necessary in existing devices (notably at a high brightness) to apply high drive voltages to the column electrodes, which increases the power consumption.

The power consumption is even further reduced in that the column electrodes are now capacitively loaded to a much lesser extent. The capacitance of a single diode is much smaller than that of a complete pixel. Since this capacitance is smaller, it is also possible to provide an extra capacitance which functions as an auxiliary capacitance.

An embodiment of a display device with pixels arranged in rows and columns and comprising a substrate having a first pattern of strips of conducting material and a layer of insulating material across which a second pattern of strips of conducting material extends, in which the strips of the first and the second pattern constitute a crossbar system and in which, at the location of a pixel, parts of the second pattern and the subjacent insulating material have at least one aperture in which a field emitter is realised is characterized in that each group of field emitters associated with a pixel is connected in an electrically conducting manner to a first terminal of a two-pole circuit, while the second terminal of the two-pole circuit is connected in an electrically conducting manner to a strip of the first pattern.

Dependent on the embodiment, the two-pole circuit may be connected to the field emitters (possibly via a resistance layer), in which the first pattern is formed by column electrodes which are directly or not directly provided on the substrate. When the column electrodes are provided on the substrate, a short-circuit protection may be built in a simple manner by separating the first pattern laterally from the areas where field emission occurs. The grid electrodes associated with the second pattern are usually integrated to form strip-shaped row electrodes.

BRIEF DESCRIPTION OF THE DRAWINGS

These other aspects of the invention will be apparent from the embodiments described hereinafter and elucidated with reference to the drawings, in which:

FIG. 3 shows a device according to the invention, also in an electric circuit diagram, FIGS. 4*a* through 4*d* control signals associated with the device of FIG. 3, FIGS. 5 through 7 show embodiments of a part of a display device according to the invention, while

DESCRIPTION OF THE PREFERRED EMBODIMENT

Figure 1:
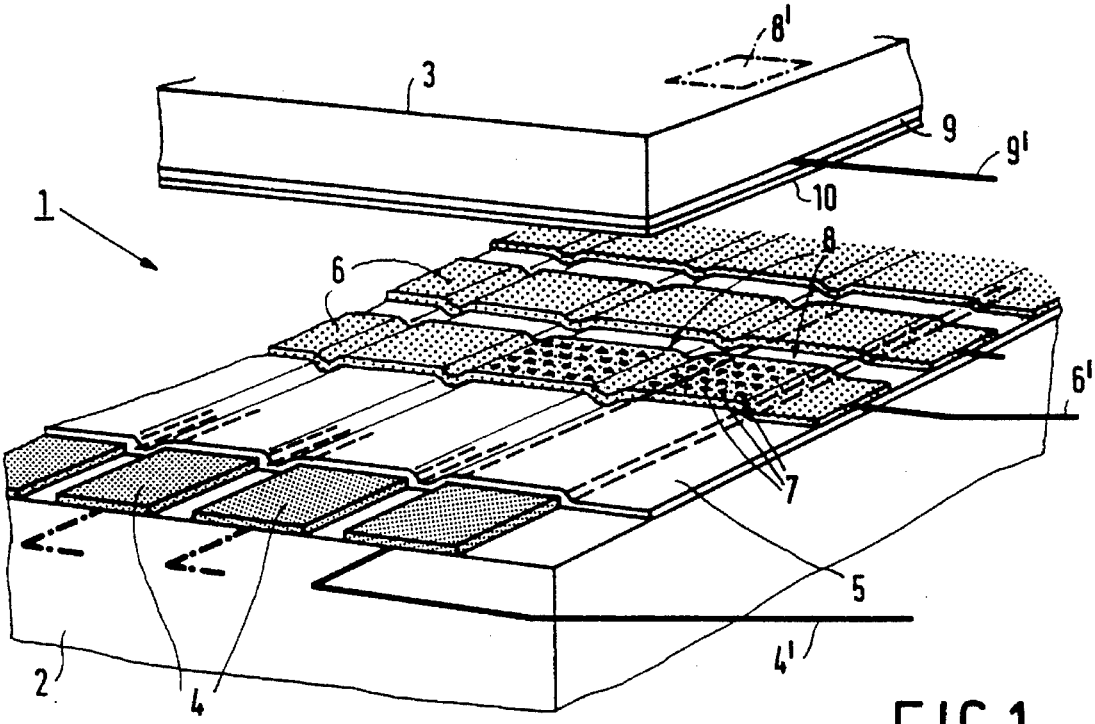
FIG.1 PRIOR ART
FIG. 1 shows diagrammatically a part of a known display device.

FIG. 1 shows diagrammatically a part of a known display device 1, based on field emission. This device comprises two facing glass substrates 2 and 3. The substrate 2 comprises a first pattern of parallel conductors of, for example tungsten or molybdenum which function as row electrodes 4 in this case. With the exception of the areas near the ends 4' of the row electrodes, where they are not insulated for the purpose of connection to external contacts, the entire device is coated with an insulating layer 5 of silicon oxide. Column electrodes 6, of, for example molybdenum having a plurality of apertures 7 at the location of the crossings extend across the insulating layer 5 perpendicularly to the row electrodes 4. In these apertures, which extend across the thickness of the subjacent insulating layer, a plurality of field emitters is realised on the row electrodes 4. These field emitters are usually tip-shaped, conical or pointed. The pixels 8 are present at the locations of the crossings of the row and column electrodes.

The substrate 3 has a conducting layer 9 which is provided with a layer 10 having, for example a pattern of phosphors or (in a monochrome display device) a single phosphor layer. By giving the electrode 9 (anode) a sufficiently high voltage, electrons emitted by the field emitters are accelerated towards the substrate 3 (the face plate) where they cause a part 8' of the phosphor pattern corresponding to a pixel 8 to luminesce. The quantity of emitted electrons can be modulated with voltages across grid electrodes integrated to column electrodes 6, via connections 6'.

Figure 2:
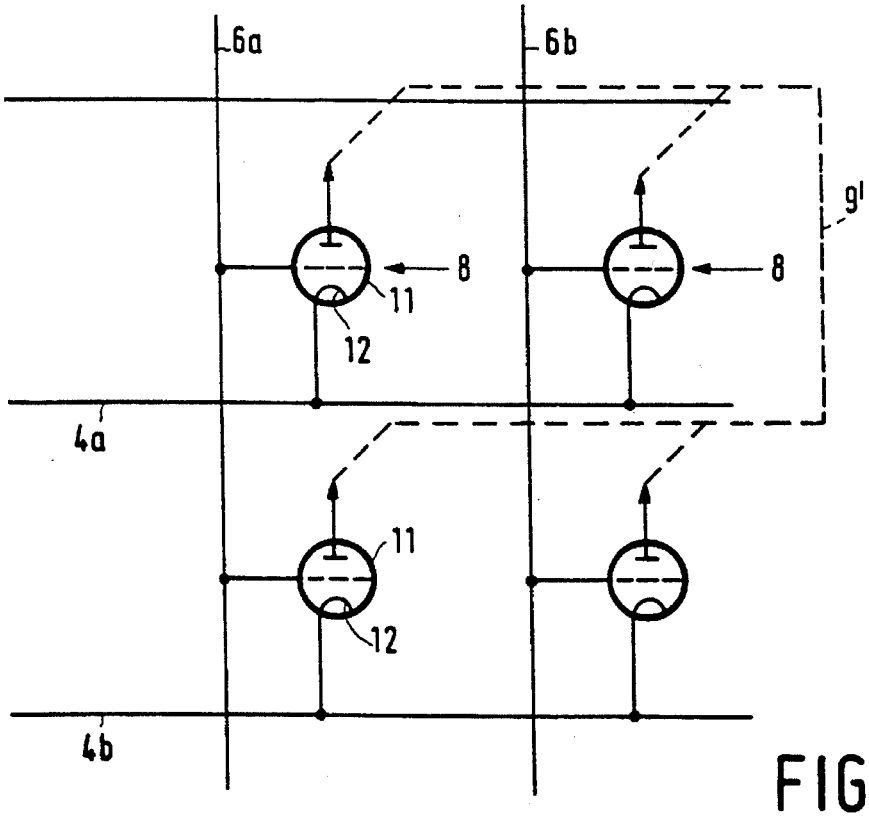
FIG.2 PRIOR ART
FIG. 2 shows the device of FIG. 1 in an electric circuit diagram.

FIG. 2 is a simplified representation of an equivalent circuit diagram of the display device of FIG. 1. Pixels 8 are present at the location of the crossings of row electrodes 4 and column electrodes 6. In FIG. 2 the pixels 8 are shown by means of triodes 11, a cathode 12 of which is always formed by the field emitters associated with a pixel, while a grid is formed by the part of a column electrode which is provided with apertures 7 at the location of a crossing with a row electrode. The anode 9 is common for all triodes 11, which is diagrammatically shown in FIG. 2 by means of a plane 9' in broken lines.

During operation the row electrodes $4^a$, $4^b$ are selected during successive selection periods while a data signal is presented to the column electrode $6^6$, which together with the signal at the row electrodes $4^a$, $4^b$ defines the voltage across the field emitters at the location of the crossings and hence the field emission and consequently the light intensity of the pixels $8^{aa}$, $8^{ab}$. After the selection period has elapsed, the row electrodes receive a voltage of (for example) 0 Volt, so no longer any field emission in the relevant rows occurs.

The quantity of emitted electrons should be sufficient to cause the pixels 8 to luminesce in the correct way. Since the selection period (32 μsec) is short with respect to a frame period (20 msec), a high emission should be used so as to realise the light intensity required within the selection period for the relevant frame period. The high voltages required not only increase the risk of breakdown (for example, between a field emitter and a grid) but also increase the power required for operation. Another problem is the variation of the current-voltage characteristics of the field emitters, which variation is greatly dependent on the method of manufacture. Moreover, the use of high voltages influences the behaviour of the phosphors, because the phosphor saturation increases with the value of the electron current, notably for red phosphors. Due to this phosphor saturation, a disproportionately large electron current is required for an increasing brightness. This does not only require a higher voltage and more power, but a much larger number of electrons also impinges upon the phosphor, which reduces its lifetime.

The display device of FIG. 3 shows a plurality of pixels 8 (triodes 11 ) arranged in the form of a matrix. The cathodes 12, i.e. the associated field emitter(s) are now connected in an electrically conducting manner to column electrodes 14 via diodes 13 or other suitable two-pole circuits, while the grids of the triodes 11 are connected in an electrically conducting manner to row electrodes 16. The capacitance between a grid and a column electrode 14 is denoted by the reference numeral 15. This capacitance which detrimentally influences the operation of the circuit in the device of FIG. 1 plays an essential role in the device according to the invention, as will be described hereinafter. The anode 9' is again shown as common for all triodes 11.

The display device of FIG. 3 is driven as follows (see FIG. 4). At the instant $t_0$ a (for example) positive selection voltage $V_s$ is presented to the row electrodes $14^a$ during a selection period $T_s$ (see FIG. $4^a$). Simultaneously, a data signal $V_d$ is presented to the column electrode $16^6$ (see FIG. $4^d$) which, together with the signal at the row electrode $14^a$, defines the voltage across the field emitter(s) and hence the field emission of the pixel $8^{aa}$. After the selection period $T_s$ has elapsed, the row electrode $14^a$ receives a voltage $V_{ns}$ of (for example) 0 Volt at which no field emission occurs in the relevant row. At the instant $t_1$ the selection voltage $V_s$ is presented to the row electrodes $14^b$ during a selection period $T_s$ (see FIG. $4^b$). Simultaneously, a data signal $V_d$ is presented to the column electrode $16^a$ (see FIG. $4^d$) which, together with the signal at the row electrode $14^b$ defines the voltage across the field emitter(s) and hence the field emission of the pixel $8^{ab}$. After the selection period $T_a$ has elapsed, the row electrode $14^b$ receives a voltage $V_{ns}$, etc. The row electrodes $14^a$, $14^b$, . . . are selected, for example, with the aid of a demultiplex circuit (or shift register) 30 which in this example selects the row electrodes consecutively, while data voltages are presented to the column electrodes 16 via a register 31. To this end, an incoming signal 32 is sampled via a control circuit 33 and applied to the register 31. The control circuit 33 also ensures the mutual synchronization. During a selection period the voltage between the grid and the cathode of a pixel and across the associated capacitance 15 is $V_{gc}=V_s-V_d-V_{on}$, in which $V_{on}$ is the voltage across the diodes 13. The series resistance of the diodes 15 is much smaller than that of the field emitters of a pixel which can be considered as a diode (these conduct (emit) only when $V_{gc}$ is positive). The capacitances 15 are then charged during a selection period (32 μsec) to a charge of $Q=C.V_{gc}$, in which C is the value of the capacitance 15, while the field emitters already emit electrons.

When the voltage at the row electrode $14^a$ changes from $V_s$ to $V_{ns}$ at the instant $t_1$ (here 0 Volt), the voltage across the capacitance 15 is maintained. The voltage at the grid of the triode (or row electrode $14^a$) will then be 0 Volt, while the voltage at the cathode of the triode will acquire a negative value of $-V_{gc}$. The capacitance 15 is then discharged during the rest of a frame period because the triode $11^{aa}$ continues to conduct (or the associated field emitters continue to emit). For a suitable structure of the field emitters (choice of the material, possibly an extra resistance layer) this emission takes place during a period of slightly less than a frame period (20 msec) whereafter the capacitance 15 is again charged in the manner described hereinbefore (dependent on the signal across the column).

Since the emission during the selection period is small with respect to that during the rest of the frame period, this emission is now substantially completely defined by the quantity of charge across the capacitance. Since the charge across the capacitance 15 now substantially defines the emission, the selection period $T_s$ can be reduced to the period required to charge this capacitance 15. This period is usually shorter than 32 μsec. As a result, variations in the current-voltage characteristics of field emitters of different pixels are compensated for by contradistinctive variations in discharge time of the associated capacitances. Since the emission takes place for a longer time, lower voltages may be sufficient. This reduces the phosphor saturation and renders a high brightness possible because, spread in time, the same quantity of electrons impinges upon the phosphor. Since the phosphors are now less driven in saturation, higher drive voltages may be used, if necessary, to achieve a higher brightness.

At sufficiently low voltages, an extra resistance layer which is usually present to avoid breakdown may be dispensed with.

Another advantage is that the column electrodes are now connected to the diodes 13 instead of constituting grid electrodes themselves. Consequently, the capacitive load of these column electrodes is much smaller. This in turn leads to a smaller load of drive circuits, thus simplifying and realising them at lower cost. Together with the mentioned decrease of the drive voltage, this leads to a considerably smaller energy consumption, and hence to low-cost power supply circuits.

Figure 5:
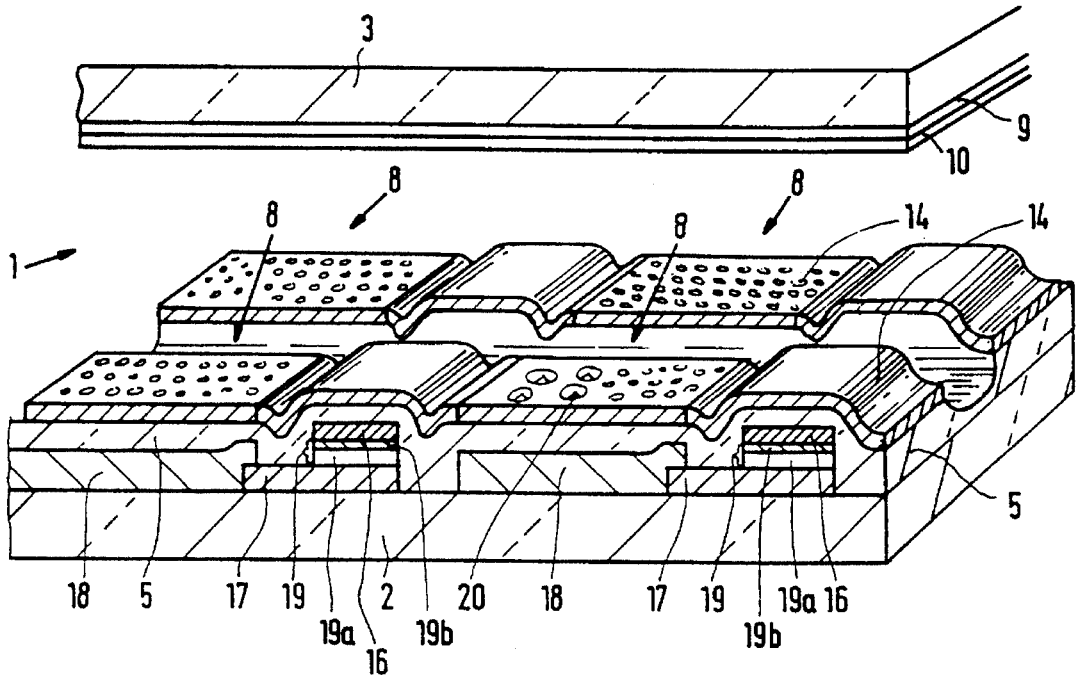

FIG. 5 shows diagrammatically a part of a display device according to the invention. The display device comprises two facing substrates 2, 3 of, for example glass. At the location of the pixels 8 island-shaped metal regions 17 of, for example niobium or molybdenum which contact semiconductor regions 18 and 19 are present on the first substrate 2. The semiconductor region 18 is present on the substrate 2 in this embodiment, but the metal region 17 may also extend completely under this region 18. The lower sub-layer $19^a$ of the semiconductor layer is very weakly doped or substantially intrinsic so that the subjacent metal 17 forms a Schottky diode with this sub-layer. The upper sub-layer $19^b$ is of the $n^+$type and constitutes an ohmic connection with a metal column conductor of, for example molybdenum. The column electrodes 16 extend parallel to each other. Column electrodes 16 and semiconductor regions 18, also of the $n^+$type are coated with a layer of insulating material 5 across which parallel row electrodes 14 extend transversely to the direction of the column electrodes 16.

At the location of the pixels 8 (i.e. at locations where the row electrodes 14 are present above semiconductor regions 18 in this embodiment) the row electrodes as well as the subjacent insulating material 5 (for example, silicon oxide) are provided with apertures which extend as far as the surface of the semiconductor region 18. Tip-shaped or conical field emitters are provided on this surface in known manner v/a the afore-mentioned apertures, which emitters are indicated diagrammatically by means of the reference numeral 20 in one of the pixels of FIG. 6. The semiconductor region 18 constitutes a cathode connection for the field emitters with which there are connected in an electrically conducting manner. The substrate 3 has a conducting layer 9 of, for example indium-tin oxide which is provided with a layer 10 having, for example a pattern of phosphors.

Figure 6:
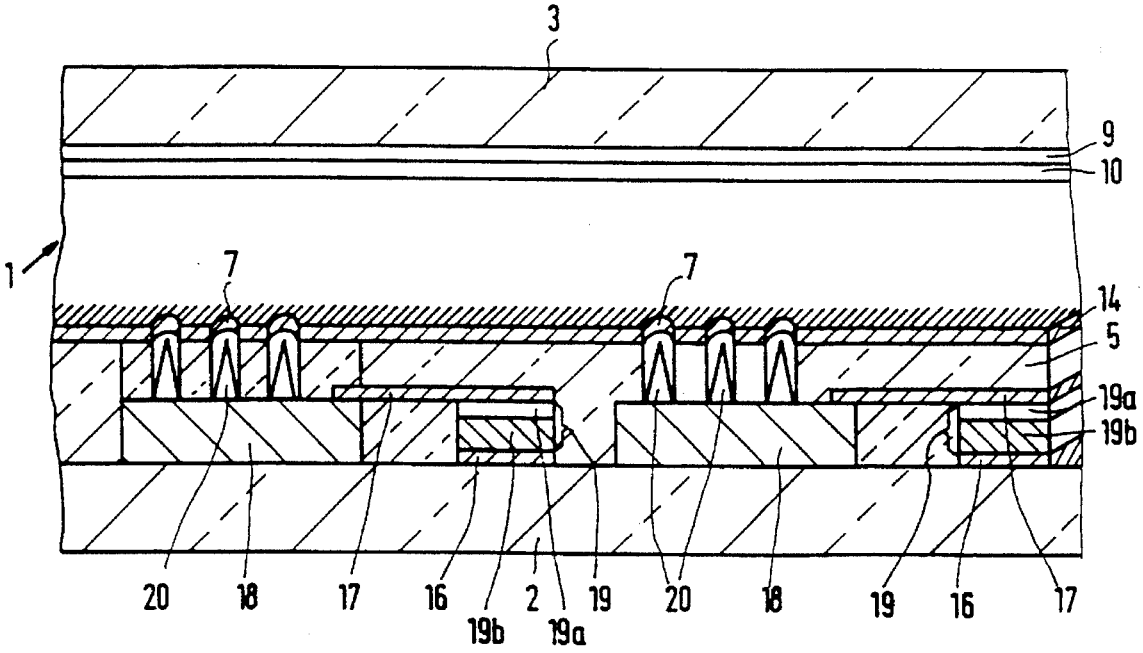

FIG. 6 is a diagrammatic cross-section of a modification of the device of FIG. 5. The column electrodes 16 are now present on the substrate 2. At the location of the pixels the column electrodes are coated with a thin layer of amorphous silicon 19 in which (Schottky) diodes are realised by forming the lower sub-layers $19^b$ as highly doped $n^+$layers and the upper sub-layers $19^a$ as intrinsic layers which are contacted by metal strips 17 of, for example molybdenum. In this embodiment the metal strips constitute a Schottky diode together with the subjacent intrinsic amorphous silicon; if necessary, a pn diode may be realised in this case by giving the sub-layer $19^a$ a p-type doping. The other reference numerals refer to the same components as those in FIG. 5.

Figure 7:
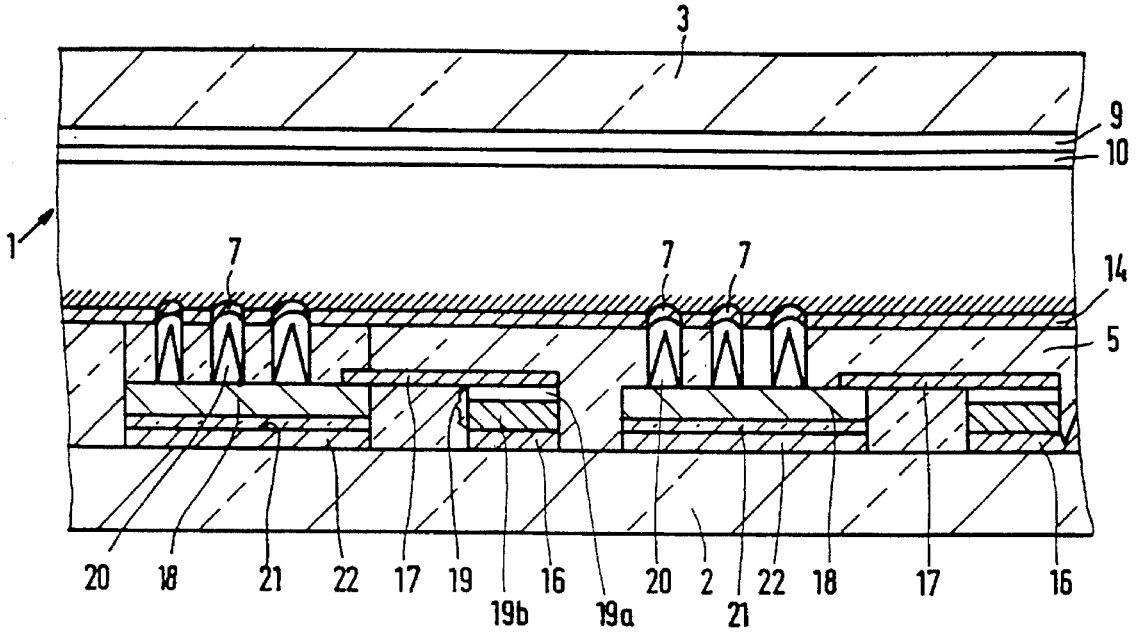
Figure 8:
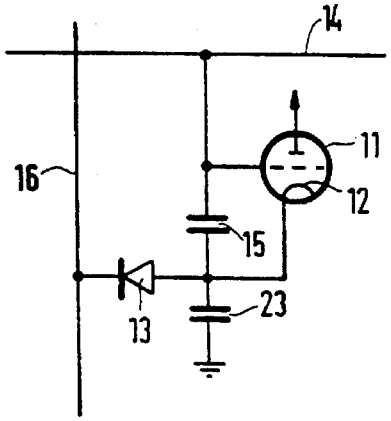
FIG. 8 shows the electric circuit diagram of a pixel of the display device of FIG. 7, and FIGS. 9*a* and *b* embodiments of an asymmetric two-pole circuit.
Figure 9A:
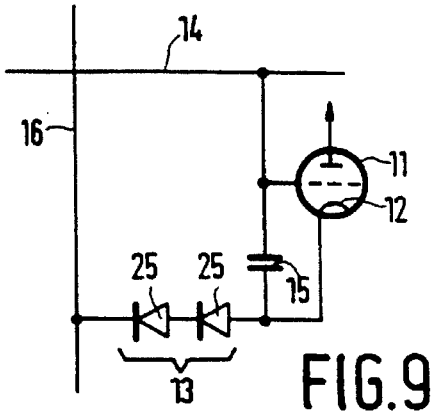
Figure 9B:
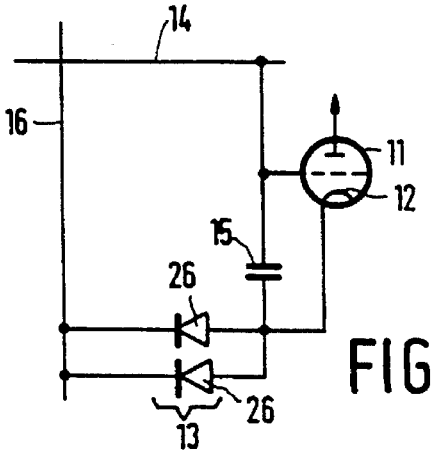

FIG. 7 shows a modification of the device of FIG. 6. At the location of the semiconductor regions 18 extra insulating layers 21 and metal faces 22 constituting extra capacitances together with the $n^+$type semiconductor regions are present below these regions, as is shown for one pixel in the equivalent circuit diagram of FIG. 8; the extra capacitance is denoted by the reference numeral 23.

The invention is of course not limited to the embodiments shown, but several variations are possible within the scope of the invention. For example, the layer 18 may be formed as a metal layer due to the reduced risk of breakdown at a lower voltage.

As already stated, series circuits and/or parallel circuits may be used instead of single diodes 13 or other two-pole circuits for reasons of redundancy. For example, the switching unit 13 in FIG. $9^a$ comprises two series-arranged diodes 25, while the switching unit 13 in FIG. $9^b$ comprises two parallel-arranged diodes 26. A pixel 8 (semiconductor region 18) may be divided into sub-pixels (sub-regions), also for reasons of redundancy.

Instead of using asymmetric circuits, it is alternatively possible to use symmetric circuits, provided that these have such a high threshold voltage that there is no discharge of the capacitance during non-selection.

We claim:

1. A display device comprising a plurality of pixels arranged in rows and columns at the location of crossings of row electrodes and column electrodes, each pixel comprising at least one field emitter and a grid electrode, characterized in that each pixel is provided with an asymmetric two-terminal device electrically arranged between a column electrode and the field emitter.

2. A display device comprising a plurality of pixels arranged in rows and columns at the location of crossings of row electrodes and column electrodes, each pixel comprising at least one field emitter connected to a cathode terminal in an electrically conducting manner and a grid electrode, characterized in that each pixel comprises an asymmetric two-terminal device between a column electrode and a field emitter.

3. A display device as claimed in claim 1, characterized in that the two-terminal devices comprise one or more diodes.

4. A display device as claimed in claim 3, characterized in that the display device comprises means for selecting row electrodes while simultaneously presenting data voltages to the column electrodes.

5. A display device as claimed in claim 2, characterized in that the two-terminal devices comprise one or more diodes.

6. A display device as claimed in claim 2, characterized in that the display device comprises means for selecting row electrodes while simultaneously presenting data voltages to the column electrodes.

7. A display device with pixels arranged in rows and columns, comprising a substrate having a first pattern of strips of conducting material and a layer of insulating material across which a second pattern of conducting material extends, in which the strips of the first and the second pattern constitute a crossbar system and in which, at the location of a pixel, parts of the second pattern and the subjacent insulating material have at least one aperture in which a field emitter is realized, characterized in that each group of field emitters associated with a pixel is connected in an electrically conducting manner to a first terminal of an asymmetric two-terminal device, while the second terminal of the two-terminal device is connected in an electrically conducting manner to a strip of the first pattern.

8. A display device as claimed in claim 7, characterized in that the first pattern is present on the first substrate and is laterally separated from conducting regions for field emitters associated with pixels.

9. A display device as claimed in claim 1, characterized in that the display device comprises means for selecting row electrodes while simultaneously presenting data voltages to the column electrodes.

10. A display device comprising a plurality of pixels arranged in rows and column at the location of crossings of row electrodes and column electrodes, each pixel comprising at least one field emitter connected to a cathode terminal in an electrically conducting manner and a grid electrode, characterized in that each pixel comprises an asymmetric two-terminal device between a column electrode and a field emitter, said asymmetric two-terminal device comprising a plurality of series-arranged sub-circuits.

11. A display device as claimed in claim 10, characterized in that the two-terminal devices comprise one or more diodes.

12. A display device as claimed in claim 10, characterized in that the display device comprises means for selecting row electrodes while simultaneously presenting data voltages to the column electrodes.

13. A display device comprising a plurality of pixels arranged in rows and columns at the location of crossings of row electrodes and column electrodes, each pixel comprising at least one field emitter connected to a cathode terminal in an electrically conducting manner and a grid electrode, characterized in that each pixel comprises an asymmetric two-terminal device between a column electrode and a field emitter, said asymmetric two-terminal device comprising a parallel arrangement of a plurality of sub-circuits.

14. A display device as claimed in claim 13, characterized in that the two-terminal devices comprise one or more diodes.

15. A display device as claimed in claim 13, characterized in that the display device comprises means for selecting row electrodes while simultaneously presenting data voltages to the column electrodes.

16. A display device comprising a plurality of pixels arranged in rows and columns at the location of crossings of row electrodes and column electrodes, each pixel comprising at least one field emitter and a grid electrode, characterized in that each pixel is provided with an asymmetric two-terminal device electrically arranged between a column electrode and a field emitter, said asymmetric two-terminal device comprising an extra capacitor a terminal of which is connected to the field emitter in an electrically conducting manner.

17. A display device as claimed in claim 16, characterized in that the display device comprises means for selecting row electrodes while simultaneously presenting data voltages to the column electrodes.

* * * * *